United States Patent [19]

Bente et al.

[11] 4,233,759

[45] Nov. 18, 1980

[54] OUTSOLES FOR SPORTS SHOES, PARTICULARLY FOR USE ON ARTIFICIAL GRASS

[75] Inventors: Alfred Bente, Herzogenaurach, Fed. Rep. of Germany; Adolph Dassler, deceased, late of Herzogenaurach, Fed. Rep. of Germany; by Albert Henkel, legal representative, Düsselford, Fed. Rep. of Germany

[73] Assignee: Adidas Sportschuhfabriken Adi Dassler KG, Fed. Rep. of Germany

[21] Appl. No.: 27,110

[22] Filed: Apr. 4, 1979

[30] Foreign Application Priority Data

Feb. 7, 1979 [DE] Fed. Rep. of Germany ..... 2904471

[51] Int. Cl.[3] ..... A43B 13/26; A43C 15/00

[52] U.S. Cl. ..... 36/59 R; 36/32 R; 36/67 A

[58] Field of Search ..... 36/59 R, 59 A, 59 B, 36/59 C, 67 R, 67 A, 67 D, 128, 129, 32 R

[56] References Cited

U.S. PATENT DOCUMENTS

| | | | |
|---|---|---|---|
| 2,509,980 | 5/1950 | McCallum | 36/67 D |
| 3,513,571 | 5/1970 | Larcher | 36/67 A |
| 3,577,663 | 5/1971 | Mershon | 36/67 D |
| 3,818,617 | 6/1974 | Dassler et al. | 36/67 R |
| 3,898,751 | 8/1975 | Gustin | 36/67 D |

FOREIGN PATENT DOCUMENTS

| | | | |
|---|---|---|---|
| 2717910 | 10/1978 | Fed. Rep. of Germany | 36/59 R |
| 1216016 | 11/1959 | France | 36/128 |

*Primary Examiner*—James Kee Chi

[57] ABSTRACT

In a outsole for sports shoes, each of a multiplicity of tapered anti-slip cleats is provided over its periphery with a plurality of spaced substantially parallel longitudinal ribs. The blunt tread face of each cleat may have an oblique portion, the oblique portions of at least most of the cleats between the heel and shank being inclined forwardly and those of at least most of the cleats between the toe and shank being inclined rearwardly.

10 Claims, 7 Drawing Figures

OUTSOLES FOR SPORTS SHOES, PARTICULARLY FOR USE ON ARTIFICIAL GRASS

The invention relates to outsole for sports shoes, particularly for use on artificial grass, comprising a plurality of frustoconical cleats distributed over the walking face of the outsole.

Sports shoes are known in which the walking surface of the outsole is formed with a large number of cleats or prongs made in one piece therewith. They are used primarily for running games and grass sports on surfaces where difficult ground conditions are expected, particularly hard ground. In contrast with gripper members that can be screwed off, for example studs, and which are always provided in relatively few numbers on the outsole, the larger number of prongs and particularly the smaller and therefore even more numerous cleats provide better stability when standing and, by reason of the resilience of the outsole material, facilitate a softer and gentler tread. However, a disadvantage of known outsoles with prongs and particularly cleats is that their profiling is very rapidly clogged up with dirt when the ground is wet and slimy and then provide practically no anti-slip security. This also applies to the use of sports shoes with such outsoles on the evermore popular artificial grass surfaces which have proved particularly slippery for all known outsole configurations during wet weather.

It is therefore an object of the invention to provide a footwear outsole as hereinbefore defined, which is suitable for use on artificial grass and also on natural ground surfaces and maintains the desired grip even in wet weather. According to the invention, the peripheral surface of each of the cleats is provided with a multiplicity of axially parallel fine longitudinal ribs or longitudinal grooves.

It has been found that the multiplicity of fine longitudinal ribs or grooves on the frustoconical cleats enables good anti-slip properties to be achieved even on wet artificial grass because these longitudinal ribs apparently cling to the artificial grass somewhat in the manner of a comb. Since smaller cleats are provided instead of prongs, it being possible to provide up to 160 cleats over the walking surface of the outsole, the individual plastics 'blades' of the artificial grass are held between the cleats by reason of the increased friction brought about by the longitudinal ribs. Up to 12 or 15 ribs or grooves may be distributed over the periphery of the cleats which therefore have a uniformly fluted construction. The longitudinal ribs or grooves extend from the tread face of the cleats up to the walking face of the outsole or to a disc-like raised portion by which the cleats are joined to the walking face of the outsole. The longitudinal grooves also pass through the substantially circular edge of the tread face of the cleats and therefore give this a gear-like appearance.

According to an advantageous development of the invention, the cleats have a tread face inclined to the walking face of the outsole. In addition, the aforementioned disc-like raised portion by which the cleats are joined to the walking face of the outsole may be provided with a rounded transition to the outsole. Both these features ensure that there is a considerably smaller tendency for the outsole to accumulate dirt on muddy ground. The effect particularly of the oblique tread face is that, in view of the more tapered construction of each cleat and the resulting greater deformability, dirt accumulations are broken away in the region of the tapered or bevelled portion. Consequently, at least the height of the cleats over which the oblique tread face extends projects beyond the dirt accumulation. Desirably, the inclination of the tread face of the cleats is pointed to different sides so that the required good grip is obtained when stepping in various directions and also when stopping.

Another improvement of the outsole is that the tread faces of at least the majority of cleats at the rear of the outsole up to the shank are inclined forwardly and of at least the majority of cleats at the front of the outsole up to the shank are inclined rearwardly. Thus, most of the cleats and preferably all of them have an oblique tread face, the tread faces of the cleats at the front of the outsole pointing to the back and those of the cleats on the rear of the outsole pointing to the front. The oblique tread face can be so arranged that to some extent a tread face remains which is parallel to the walking face of the outsole, this being desirable because it reduces the wear at the free ends of the cleats.

This construction provides the surprising advantage that wear of the cleats is considerably reduced without detrimentally influencing the gripping and anti-slip security. A larger gripping surface is available because of the stated bevelling and its arrangement relatively to the outsole. The reduction in material at the free end region of the cleats makes these more easily deformable and thus the tread face is better able to adapt to the ground conditions. This applies particularly to hard ground surfaces. However, even on soft ground the anti-slip property is not affected because, by reason of the obliquely extending tread face, the cleats are better able to penetrate the ground.

By means of the described arrangement and construction of the cleats, the outsole also tends to give a softer tread because the deformability is always effective in the same direction.

Other advantages and features of the invention will be evident from the following description of examples illustrated in the accompanying drawings, wherein:

FIG. 1 is a side elevation of a sports shoe equipped with a outsole according to the invention and showing the approximate relationship between the size of the cleats and the dimensions of the outsole;

FIGS. 2*a* and 2*b* are enlarged fragmentary perspective views of alternative constructions for the cleats of the outsole in FIG. 1;

Figure 1:
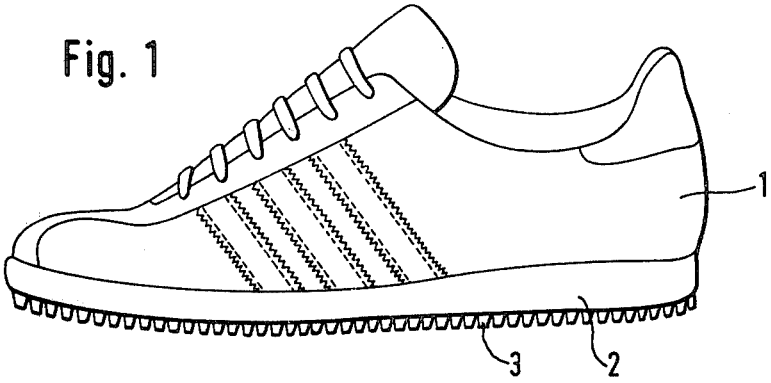

The sports shoe shown in FIG. 1 has been specifically designed for grass sports on artificial lawns or turf and comprises an upper 1 and a outsole 2 in the form of a shell sole, the rim of the shell being flanged upwardly to extend a small distance along the upper and being cemented and/or stitched thereto. The walking surface of the outsole 2 carries a multiplicity of cleats 3, for example 160 such cleats, which are uniformly distributed over the outsole. The cleats 3 are formed in one piece with the sole 2. The material of the outsole and cleats is preferably natural or synthetic rubber.

Figure 2A:
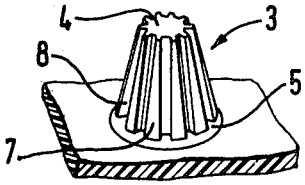
Figure 2B:
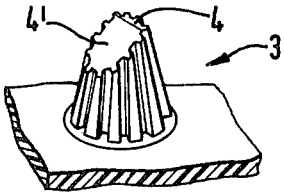

As will be evident from FIGS. 2*a* and 2*b*, the cleats 3 have a substantially frustoconical shape and are provided with a blunt tread face 4. In addition, they are joined to the outsole 2 by a disc-like raised portion 5 which is rounded where it merges with the outsole 2.

On their peripheral surface, the cleats 3 carry a multiplicity of axially parallel fine longitudinal ribs 7 defining between each other longitudinal grooves 8 which pass through the tread face 4. In the illustrated example, there are 10 longitudinal ribs 7 and grooves 8 over the periphery. The longitudinal grooves 8 have a constant width and consequently the thickness of the longitudinal ribs 7 increases towards the walking surface of the outsole.

The embodiment of the cleat 3 shown in FIG. 2*b* differs from that of FIG. 2*a* in that only a small portion of the tread face 4 extends parallel to the walking face of the outsole 2, the greater part being inclined to the walking face. The inclined or oblique portion 4' of the tread face 4 can be convex, concave or planar. This construction makes the peripheral surface of the cleats 3 nonuniform and 'weakens' the free end portion of the cleats, thereby reducing the tendency to accumulate dirt and enhancing the deformability in the region of the end portion and thus facilitating the breaking away of any dirt particles that may have accumulated.

The cleats 3 shown in FIGS. 2*a* and 2*b* in practice have a height of about 7 mm, a base diameter of about 9 mm and a diameter at the tread face 4 of about 4 mm. With 12 longitudinal ribs 7, the longitudinal grooves 8 have a width of about 1 mm and a depth of between 0.5 and 1 mm.

Figure 3:
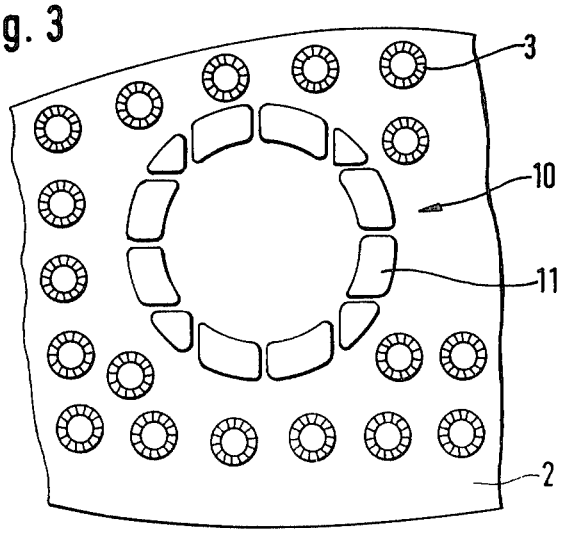
FIG. 3 is a fragmentary underplan in the ball region of a outsole provided with a localised ring profile.

As will be evident from FIG. 3, the inner ball region of the outsole 2 is provided with one ring of a ring profile 10 which is composed of individual ring segments. The ring segments 11 are so shaped that they offer little resistance to rotation. In addition, they have at least the same height as the cleats 3 surrounding the ring so that they will make contact with the ground, and they are rounded at the edges. It will be evident from FIG. 3 that the cross-section of the individual segments 11 is different so that the direction in which the segments tend to be deformed or flexed is different. The segments therefore 'work' in opposition during formation and eject any dirt accumulated between the segments. The diameter of the ring profile 10 is from about 4.5 to 5.5 cm.

The cleats 3 to which higher or more frequent forces are applied than others, for example the cleats in the region of the heel of the outsole, are desirably made thicker than the rest. It is also advantageous in cases where the edges of the outsole are curved to provide knobs 3 in the region of the curvature so that the cleats will project obliquely outwardly.

Figure 4:
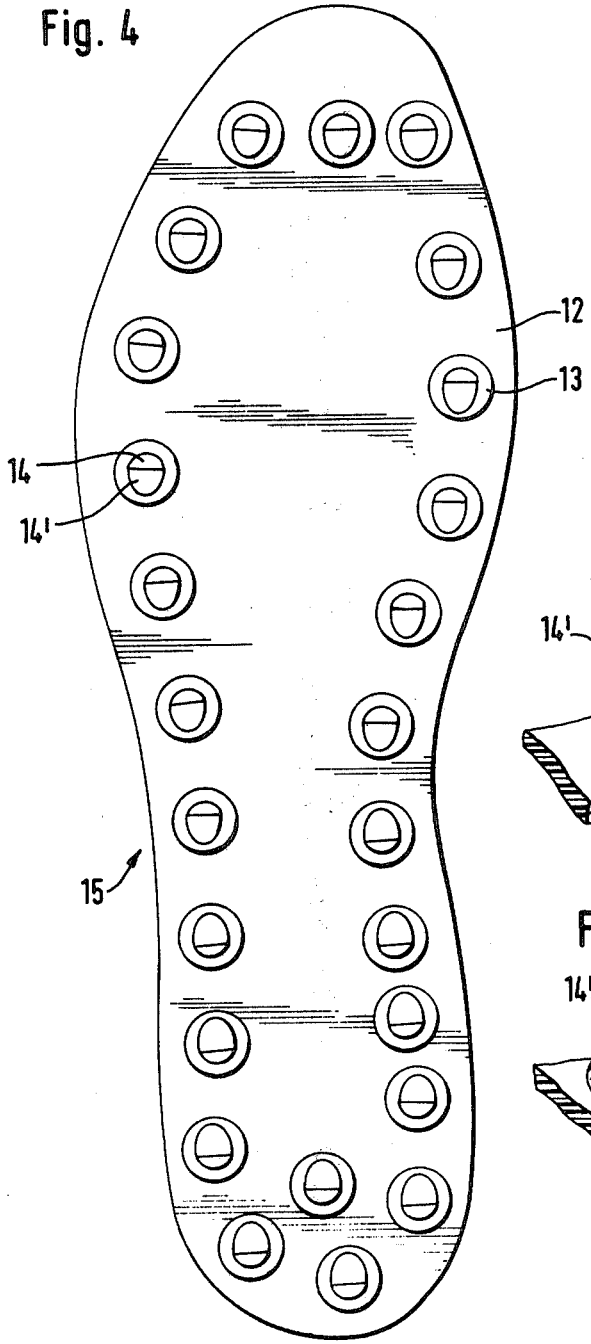
FIG. 4 is an underplan of another embodiment of a outsole according to the invention.

The outsole 12 shown in FIG. 4, which may also be a shell outsole, carries a multiplicity of cleats 13, for example 160 such cleats, which are substantially uniformly distributed over the walking face of the outsole 12. The cleats 13 are formed in one piece with the outsole 12 and the sole material is preferably natural or synthetic rubber.

Figure 5A:
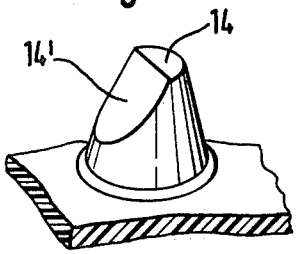
FIGS. 5*a* and 5*b* are enlarged pictorial views of alternative constructions of the cleats for use with the FIG. 4 outsole.
Figure 5B:
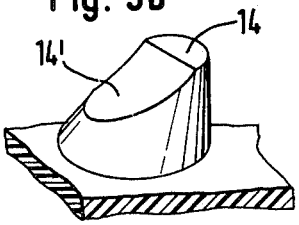

As is more clearly shown in FIGS. 5*a* and 5*b*, the cleats 13 are of substantially frustoconical shape and have a tread face 14. The tread face 14, which extends parallel to the walking face of the outsole 12, forms only a portion of the entire tread face because its major part, namely the tread face 14', is inclined to the walking face. In the case of FIG. 5*a*, the inclined tread face is concave.

As will be evident from the underplan of FIG. 4, the cleats 13 are so arranged on the walking face of the outsole 12 and they are so constructed that all the cleats on the front portion of the outsole up to the shank 15 have their inclined tread face 14' pointing rearwardly, whereas from the shank 15 up to the edge at the heel of the outsole the inclined tread face 14' of the cleats 13 point to the front.

FIG. 5*b* shows a construction in which the cleats 13 have the shape of an oblique frustum of a cone of which the axis is not normal to the walking face of the outsole. It may be desirable to provide cleats 13 of this construction near the edges of the outsole on the inside and outside, the axis of each cone being inclined outwardly so that the cleats have an obliquely outwardly directed position.

As in FIGS. 1 to 3, the cleats 13 may be provided at the periphery with longitudinal ribs or longitudinal grooves, but this is not essential. Further, it will be understood that a departure can be made from the arrangement and distribution of the cleats 13 over the walking face of the outsole 12. Thus, in one particular embodiment it is possible to provide all of the walking face with cleats except perhaps in the shank region 15. Also, the cleats 13 along the edge of the outsole may be differently arranged from the great majority of other cleats in that the inclined tread face 14' is pointed outwardly.

We claim:

1. An outsole for a sports shoe made from a resiliently deformable material and comprising a multiplicity of deformable frustoconical cleats distributed over the tread side of the outsole and integral therewith, wherein the peripheral surface of the cleats is provided with a multiplicity of axially parallel fine longitudinal ribs and grooves, said ribs and grooves extending over the entire axial length of the cleats.

2. The outsole of claim 1, wherein said cleats are joined to said tread side by a disc-like raised portion.

3. The outsole of claim 2, wherein the fine longitudinal ribs extend up to the circular edge of said disc-like raised portion.

4. The outsole of claim 1, wherein said longitudinal grooves are of constant width.

5. The outsole of claim 1, wherein said cleats have a tread face inclined to the tread side of said outsole.

6. The outsole of claim 5, wherein said tread face of the cleats adjacent the edge of the outsole extends outwardly and upwardly.

7. The outsole of claim 5, wherein the inclined tread faces of at least the majority of cleats at the rear of the outsole up to the shank are inclined forwardly and that of at least the majority of the cleats at the front of the outsole up to the shank are inclined rearwardly.

8. An outsole for a sports shoe made from a resiliently deformable material and comprising a multiplicity of deformable cleats distributed over the tread side of the outsole and integral therewith, the cleats having a base joined to the tread side of the outsole, a peripheral substantially frustoconical face and a tread face, said tread face having a first tread face portion extending substantially parallel to said base, and a second tread face portion extending obliquely toward said base, thereby forming a tip of each cleat of additional deformability.

9. The outsole of claim 8, wherein said cleats adjacent the edge of the outsole have the form of an outwardly directed oblique frustum of a cone.

10. An outsole according to claim 8, wherein the oblique tread face portions of at least the majority of the cleats at the rear of the outsole are inclined forwardly and wherein the oblique tread face portions of at least the majority of the cleats at the front of the outsole are inclined rearwardly.

* * * * *